United States Patent [19]

Skinner

[11] Patent Number: 4,509,691

[45] Date of Patent: Apr. 9, 1985

[54] FUEL INJECTION NOZZLES

[75] Inventor: Robert T. J. Skinner, High Wycombe, England

[73] Assignee: Lucas Industries Public Limited Company, Birmingham, England

[21] Appl. No.: 502,169

[22] Filed: Jun. 8, 1983

[30] Foreign Application Priority Data

Jul. 15, 1982 [GB] United Kingdom ..... 8220491
Oct. 20, 1982 [GB] United Kingdom ..... 8229951

[51] Int. Cl.[3] ..... F02M 61/10; F02M 61/20
[52] U.S. Cl. ..... 239/533.9
[58] Field of Search ..... 239/533.2–533.12

[56] References Cited

U.S. PATENT DOCUMENTS 3,387,790 6/1968 De Luca ..... 239/533.12 X

FOREIGN PATENT DOCUMENTS 2110004 9/1971 Fed. Rep. of Germany ... 239/533.3
1285153 8/1972 United Kingdom ..... 239/533.3
1391330 4/1975 United Kingdom ..... 239/533.9

*Primary Examiner*—Andres Kashnikow

[57] ABSTRACT

A fuel injection nozzle for supplying fuel to an internal combustion engine includes a valve member slidable within a bore in a nozzle body. The valve member has a drilling in which is slidable a sleeve member. The sleeve member is in end to end sealing engagement with a tubular member through which fuel can flow from a fuel inlet to an outlet when the valve member is lifted from a seating.

6 Claims, 8 Drawing Figures

Figure 3:
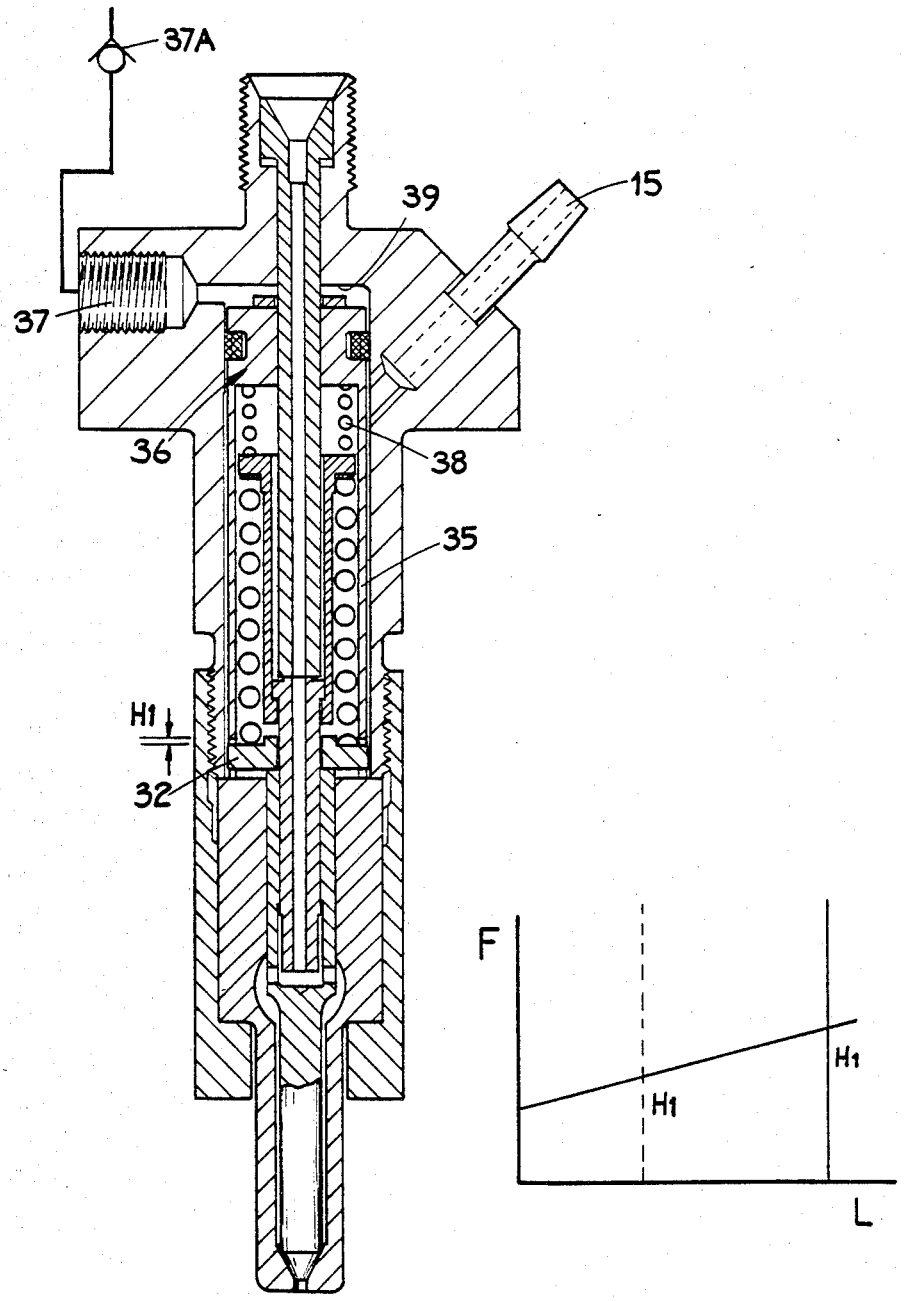

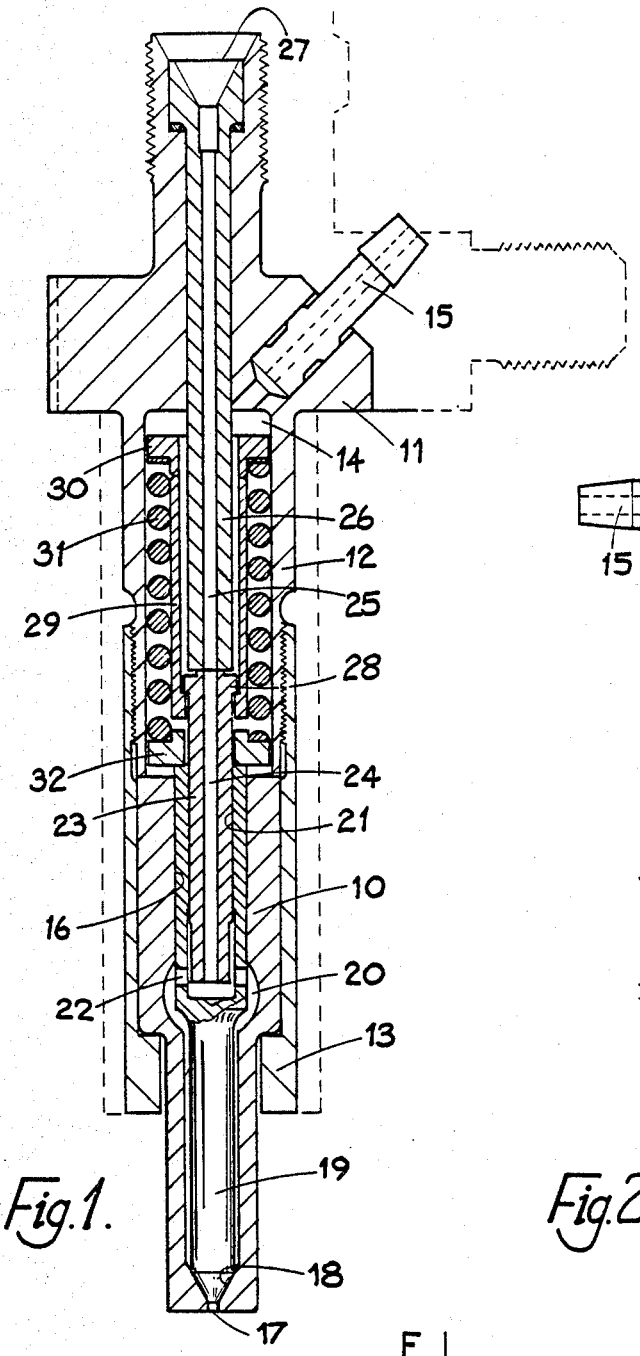
Fig.1.
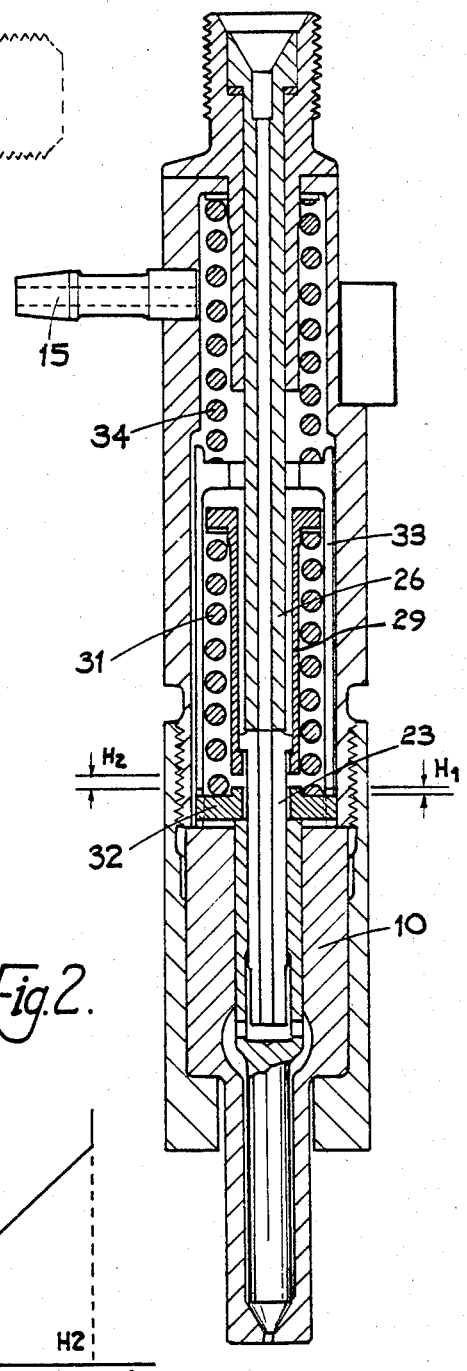
Fig.2.
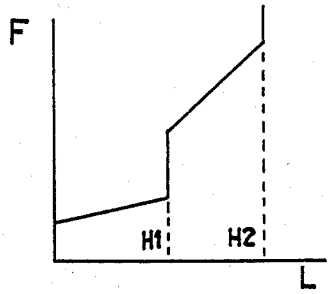

FUEL INJECTION NOZZLES

This invention relates to fuel injection nozzles for supplying fuel to internal combustion engines and of the kind comprising a nozzle body, a bore formed in the body and an outlet communicating with one end of the bore, a seating defined in the bore adjacent the outlet and a valve member movable within the bore and shaped for co-operation with the seating to control the flow of fuel from the bore through the outlet.

It is known in fuel injection nozzles to provide an enlargement intermediate the ends of the bore and to convey fuel under pressure to the enlargement by means of a drilling formed in the nozzle body, the drilling communicating with a fuel inlet defined in a holder to which the nozzle body is secured. The valve member is a sliding fit in the portion of the bore which is disposed between the enlargement and the other end of the bore and defines a clearance with the portion of the bore disposed between the enlargement and the seating. Moreover, the valve member defines a surface against which fuel under pressure can act to lift the valve member from the seating against the action of resilient means.

The production of the aforesaid passage has always posed manufacturing problems since it requires accurate drilling to ensure that it breaks into the enlargement and furthermore, it requires that the nozzle body should be sufficiently thick both to accommodate the drilling and to ensure that there is an adequate wall thickness to withstand the fuel pressure.

It is known from British Patent Specification No. 1285153 to convey the fuel from the inlet to the valve member by way of a centrally disposed tubular member. The valve member is a sliding fit within a sleeve carried by the tubular member the working clearance being such as to define a substantially fuel tight seal. Fuel is conveyed towards its destination by providing an axial drilling the valve member. In addition the valve member at an axially spaced location, is slidably mounted in a bearing sleeve and again the working clearance must be such as to define a substantially fuel tight seal. The tubular member is supported in the body of the nozzle by way of two series of screw threads which must be very successfully formed to maintain concentricity of the working surfaces. It is recognised in the specification that it may be impossible to maintain the concentrically and the tubular member is therefore provided with a weakened section to promote flexibility.

The object of the present invention is to provide a fuel injection nozzle of the kind specified in a simple and convenient form.

According to the invention a fuel injection nozzle for supplying fuel to an internal combustion engine comprises a nozzle body a bore formed in the body and an outlet communicating with one end of the bore, a seating defined in the bore adjacent the outlet, a valve member movable within the bore and shaped for co-operation with the seating to control the flow of fuel from the bore through the outlet, a blind drilling formed in the valve member, said drilling extending from the end of the valve member remote from the seating, cross drillings in the valve member, said cross drillings acting to place the inner end of the blind drilling in communication with an enlargement defined in the bore, the portion of the valve member located between the enlargement and the seating being or reduced diameter, a tubular member extending into a chamber defined in a nozzle holder chamber said tubular member exterior of the holder defining a fuel inlet connected in use to an outlet of a fuel injection pump, characterized by a sleeve member slidably mounted in said mounting, said sleeve member and said tubular member engaging each other in end to end relationship to convey fuel from the inlet to the enlargement and resilient means acting to maintain said sleeve member and said tubular member in engagement.

Figure 4:
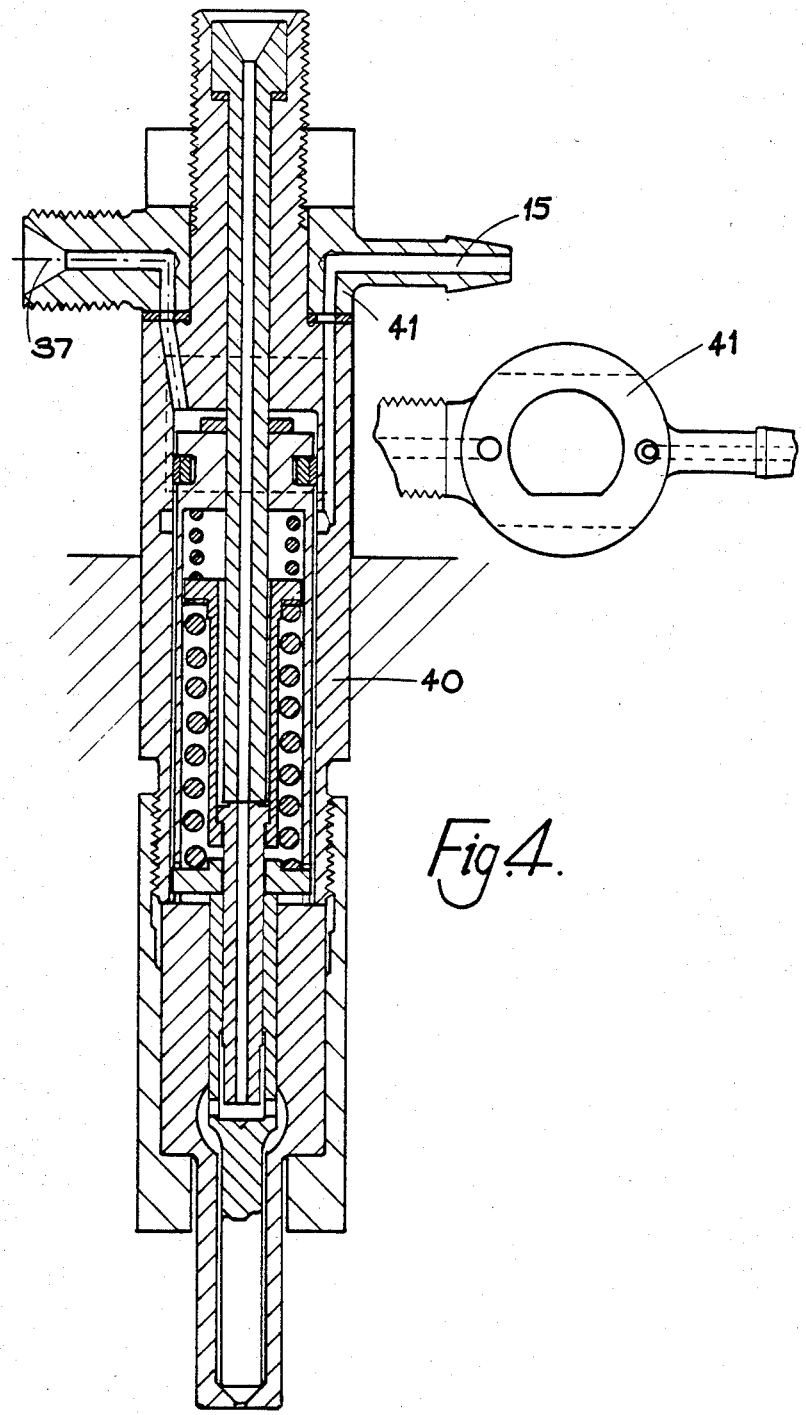
Figure 5:
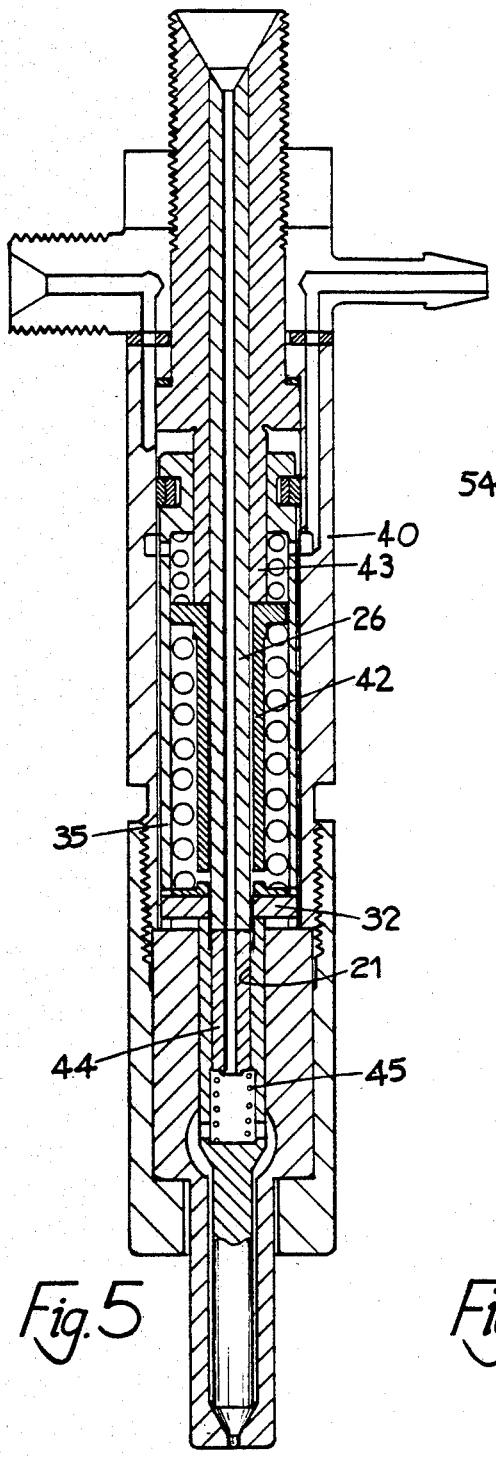
Figure 6:
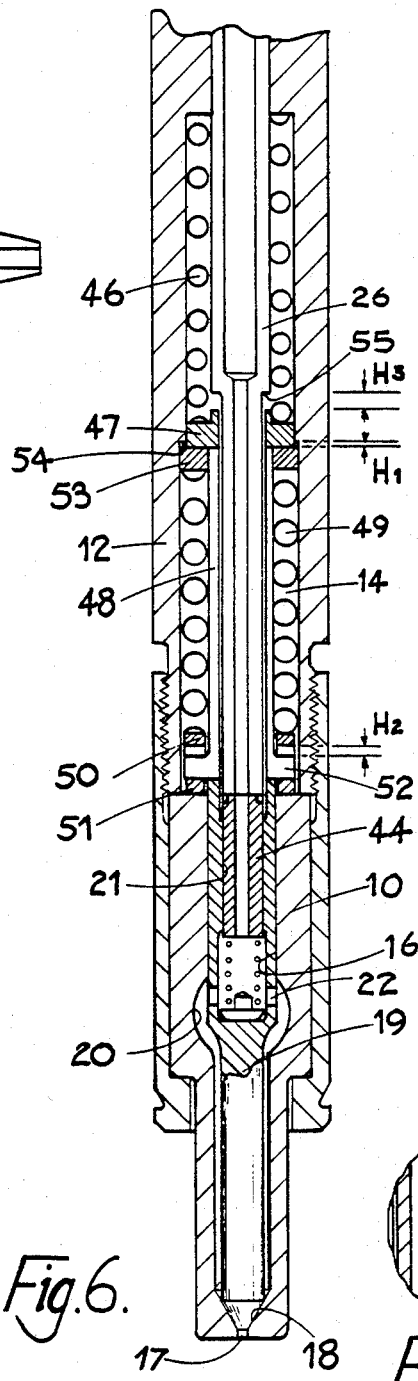
Figure 7:
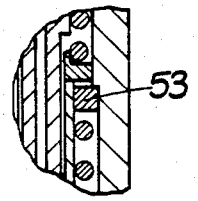
Figure 8:
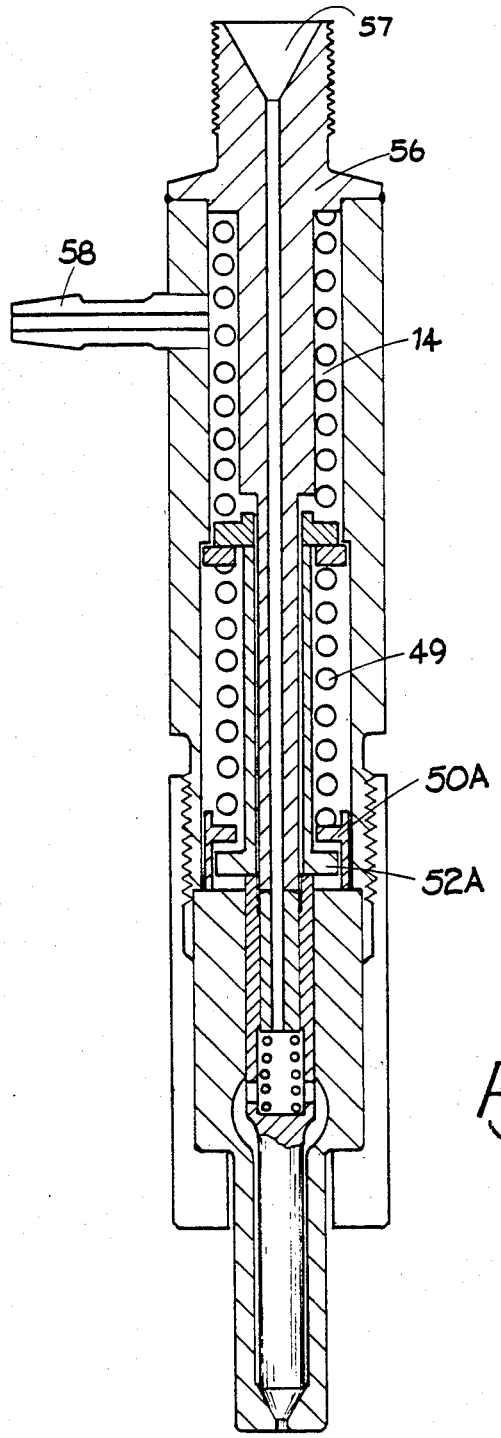

In the accompanying drawings FIGS. 1–6 and 8 are sectional side elevations of fuel injection nozzles in accordance with the invention and FIG. 7 is a view to an enlarged scale of a modification applicable to the nozzles shown in FIGS. 6 and 8.

Referring to FIG. 1 of the drawings, the nozzle includes a nozzle body 10 of stepped form the narrower end of which in use, is exposed within a combustion chamber of an associated engine. Also provided is a nozzle holder 11 which has a threaded hollow spigot portion 12 to which the nozzle body 10 is secured by means of a cap nut 13. The chamber 14 defined in the holder is in use, in communication with a drain by means of a drain outlet 15.

Formed in the nozzle body is a bore 16 one end of which communicates with an outlet 17 through which in use, fuel flows into a combustion space of the associated engine. Adjacent the outlet there is defined a seating 18 with which co-operates the shaped end of a valve member 19 slidable within the bore. Intermediate its ends the bore is provided with an enlargement 20. The portion of the valve member between the enlargement 20 and the seating, is of reduced diameter so as to define an annular clearance with the wall of the bore 16 and also to define a surface against which fuel under pressure can act to lift the valve member from the seating 18.

The portion of the valve member which is a sliding fit in the bore 16 is provided with a blind drilling 21 and at its inner end, with cross drillings 22 which open into the enlargement 20. Slidable within the drilling 21 is a sleeve member 23 which defines a central fuel supply passage 24. The passage 24 communicates with an inlet passage 25 which is defined in a tubular member 26 which passes through the holder 11 into the chamber 14 and which defines a fuel inlet 27 to which in use, a pipeline is connected to the outlet of a fuel injection pump. The portion of the sleeve member 23 which engages the tubular member in end-to-end relationship, is slightly smaller in diameter than the sleeve member for a purpose which will be described. Moreover, the sleeve member has a peripheral flange 28 with which is engaged a flange formed on the internal peripheral surface of a tubular member 24 which surrounds the tubular member 26 in spaced relationship and defining an outwardly extending flange 30 against which is located one end of a coiled compression spring 31. The other end of the compression spring 31 bears against a spring abutment 32 which is engaged with a portion of the valve member 19 which projects into the chamber 14.

In operation, fuel under pressure supplied to the inlet 27 will flow through the passages 25 and 24 and the drillings 22, to the enlargement 20 and the fuel pressure acting upon the valve member 19 will exert a force thereon tending to lift the valve member against the action of the spring 31. Once the valve member is lifted fuel can flow through the outlet 17. The fuel under pressure which acts on the end surface of the sleeve member 23, which is disposed at the inner end of the drilling 21, creates a force on the sleeve member acting to urge it into contact with the tubular member 26 thereby to establish a fuel tight seal therebetween. This force is also supplemented by the spring force. The lift of the valve member is controlled in the particular example, by the abutment 29 with the spring abutment 32.

Since the tubular member 26 and the sleeve 23 are separate components, they can move relative to each other to absorb any manufacturing tolerances which occur in the production of the various components. The construction described also obviates leakage to the exterior of the nozzle, of high pressure fuel since there are no high pressure fuel connections between the nozzle body 10 and the holder. Any fuel leakage which does occur will be into the chamber 14 and it is diverted to a drain. The nozzle can be of reduced diameter since there is no need for the passage in the nozzle body to convey the high pressure fuel to the enlargement 20. FIG. 1 shows in dotted outline, the size of a comparable standard form of injection nozzle and it will be seen that the nozzle constructed as described, is smaller in diameter. A further advantage of the nozzle construction is the reduction in force produced by the fuel under pressure, which acts to separate the nozzle body from the holder. It is thus possible to make the cap nut of lighter construction.

In the arrangement which is shown in FIG. 2, the same total lift H2 of the valve member is allowed and is again determined by the abutment of the tubular abutment 29 with the spring abutment 32. An intermediate lift H1 is however provided and this is determined by contact of the spring abutment 32 with a cup-shaped member 33 which is biased into contact with the nozzle body 10 by the action of a further preloaded spring 34. The skirt portion of the cup-shaped member 33 is provided with slots in which locate projections on the spring abutment 32. In operation therefore the valve member can move an amount H1 determined by the distance between the bases of the slots in the cup-shaped member 33 and the projections on the spring abutment. This distance is less than the total distance allowed and is against the action of the spring 31 only. As the fuel pressure increases, the valve member can then move to its maximum extent against the action of both springs. The lift diagram is shown in FIG. 2.

The nozzle which is shown in FIG. 3 is a modification of the nozzle shown in FIG. 2, and it will be seen that the spring 34 is omitted. Moreover, the cup-shaped member 33 of FIG. 2 is replaced by a cup-shaped piston member 35 which has a piston portion generally indicated at 36, slidable within the chamber defined in the nozzle holder. Fluid under pressure can be admitted to the portion of the nozzle chamber between its end wall 39 and the piston, by way of an inlet 37, from a source of fluid the pressure of which can be controlled. A check valve 37A is provided intermediate the source and the inlet. The piston member is biased by means of a spring 38 in a direction to oppose the fluid pressure applied to the piston. When the fluid pressure is at its maximum the piston assumes the position shown in the drawing with the skirt of the piston in engagement with the nozzle body 10. When the fluid pressure is zero the piston under the action of the spring 38 abuts against the end wall 39. The skirt of the piston acts as an adjustable stop to limit the lift of the valve member between the limits H1 min and H1 max shown in the lift diagram adjacent FIG. 3. When in use the spring abutment 32 engages the skirt of the piston the check valve closes to create an hydraulic lock to prevent further movement of the valve member.

The nozzle shown in FIG. 4 functions in the manner as described with reference to FIG. 3. It will be noted, however, that the nozzle holder 40 is of stepped cylindrical form and that therefore it can be machined from bar stock. The fuel inlet is constructed as previously described but the inlet 37 for fluid and the drain 15 are formed in an attachment 41 of generally cylindrical form which can be secured to the holder 40. The attachment is provided with internal passages for registration with suitable passages formed in the nozzle holder, the nozzle holder and the attachment having co-operating surfaces to ensure the correct assembly.

A modification of the nozzle shown in FIG. 4 is seen in FIG. 5. In the nozzle shown in FIG. 5 the tubular spring abutment 42 instead of being located by the tubular member 26 is located by an extension 43 defined on an insert which is located within the nozzle holder 40. As with the example of FIG. 4 contact of the spring abutment 32 with the skirt 35 of the piston determines the lift of the valve member but the maximum lift is determined by contact of the abutment 32 with the abutment 42.

The nozzle of FIG. 5 shows a further modification in that the tubular member extends into the bore 21 in the valve member but is a loose fit therein. However, slidable within the bore 21 is a tubular member 44 which is biased into sealing engagement with the tubular member 26 by means of a spring 45. When the valve member is lifted by a fuel under pressure relative movement takes place between the member 44 and the valve member.

Referring to FIG. 6 of the drawings the nozzle shown therein comprises a nozzle body 10 which is of stepped form the narrower end of which in use, is exposed within the body is the bore 16 defining the seating 18 from downstream of which extends the outlet 17. Intermediate the ends, the bore is provided with an enlargement 20 and slidable in the bore is a valve member 19. The valve member is shaped for co-operation with the seating 18 and extends outwardly beyond the wider end of the body into chamber 14 which is defined within a nozzle holder 12 secured to the body 10. Extending within the chamber is the tubular member 26 which extends into the bore formed in the portion of the valve member which generally lies between the wider end of the nozzle body 10 and the enlargement 20. As shown the tubular member 26 penetrates only a little way into the aforesaid bore and the tubular member 44 is slidable in the bore 21 and is biased into contact with the member 26 by means of a spring located in an enlarged portion of the bore 21. The bore communicates with the enlargement by way of drillings 22. The chamber 14 is maintained at a low pressure by way of a leakage passage not shown, and the arrangement is such that when fuel under pressure is admitted to the enlargement from the inlet, the fuel pressure acting on the differential area of the valve member 19 will lift same away from the seating 18 to permit fuel flow through the outlet 17.

The movement of the valve member away from the seating is opposed by the action of a spring 46, one end of which engages the end wall of the chamber 14 and the other end of which is engaged with a spring abutment 47 located about the tubular member 26 and slidable relative thereto. Between the abutment member 47 and the valve member 19 there is located a tubular distance member 48 whereby the force exerted by the spring 46 is applied to the valve member 19.

A further spring 49 is located within the chamber 14 and at its end adjacent the nozzle body 10, it engages an abutment 50 in which is formed at least a pair of axially extending slots 51 in which is located a pair of tongues 52 which extend outwardly from the distance member 48.

At its other end the spring 49 engages an abutment ring 53 and this can engage as shown, the abutment 47.

The parts of the nozzle are shown in the position which they assume when no fuel is supplied to the inlet and it will be seen that there is a clearance $H_1$ between the abutment ring 53 and a step 54 defined in the wall of the chamber, a clearance $H_2$ defined between the tongues 52 and the bnase walls of the slots 51 in the abutment 50 and a clearance $H_3$ defined on the tubular member 19. The clearance $H_1$ is smaller than the clearance $H_2$ which in turn is smaller than the clearance $H_3$.

In operation, when fuel is supplied to the inlet the pressure of fuel acting on the valve member moves the valve member against the force exerted by the spring 46 with the force exerted by the spring 49, assisting the force due to fuel pressure acting on the valve member. The valve member will move from the seating as described until the clearance $H_1$ is taken up. When this occurs further movement of the valve member is against the action of the spring 46 only until the clearance $H_2$ has been taken up. Thereafter, any further movement of the valve member will be against the combined actions of the springs 46 and 49 until the clearance $H_3$ has been taken up. Once this has taken place no further movement of the valve member will occur. Three stages of pressure/lift characteristic are therefore obtained. In the modification shown in FIG. 7, it will be seen that the clearance $H_1$ has been eliminated because the abutment ring 53 is engaged with the step 54 and there is a clearance between the ring 53 and the ring 47. The initial movement of the valve member therefore is against the action of the spring 46 and it is only when the clearance $H_2$ has been taken up that the spring 49 comes into operation to oppose the movement of the valve member.

The nozzle shown in FIG. 8 functions in the same manner as the nozzle shown in FIG. 6 but its construction is slightly different. It will be observed that the spring abutment 50A is of hollow cylindrical form and has an inwardly directed flange against which the spring 49 engages. The flange can also be engaged by a flange 52A which is formed on the distance member 48. Moreover, it will be noted that the tubular member 26 is integrally formed with an end cap 56 for the chamber 14, the end cap defining the fuel inlet 57. It will be further noted that the vent passage for the chamber 14 is illustrated, this being formed in a drain nipple 58. As with the arrangement shown in FIG. 6, the arrangement of FIG. 8 can be modified as shown in FIG. 7, to provide the two stage pressure/lift characteristic.

I claim:

1. A fuel injection nozzle for supplying fuel to an internal combustion engine comprising a nozzle body, a bore formed in the body and an outlet communicating with one end of the bore, a seating defined in the bore adjacent the outlet, a valve member movable within the bore and shaped for cooperation with the seating to control the flow of fuel from the bore through the outlet, a blind drilling formed in the valve member, said drilling extending from the end of the valve member remote from the seating, cross drillings in the valve member, said cross drillings acting to place the inner end of the blind drilling in communication with an enlargement defined in the bore, the portion of the valve member located between the enlargement and the seating being of reduced diameter, a tubular member extending into a chamber defined in a nozzle holder, said tubular member exterior of the holder defining a fuel inlet connected in use to an outlet of a fuel injection pump, characterized by a sleeve member slidably mounted in said drilling, said sleeve member and said tubular member engaging each other in end to end relationship to convey fuel from the inlet to the enlargement, a coiled compression spring acting to maintain said sleeve member and said tubular member in engagement, the end portion of the sleeve member adjacent the tubular member being provided with a peripheral flange, a tubular spring abutment located about said tubular member, said abutment defining a first flange for engagement with the flange on said sleeve member and a second flange, said coiled compression spring having one end which abuts against said second flange, and a further spring abutment engaged by the other end of said spring, said further spring abutment being engaged with the valve member, said compression spring acting to bias the valve member into contact with the seating.

2. A nozzle according to claim 1 including a cup shaped member defining a skirt portion engageable with said further spring abutment after a predetermined movement of the valve member away from the seating.

3. A nozzle according to claim 2 in which said cup shaped member defines an abutment for a further coiled compression spring which acts in conjunction with the first mentioned coiled compression spring to oppose movement of the valve member after the valve member has moved said predetermined distance.

4. A nozzle according to claim 2 in which said cup shaped member defines a piston, the nozzle including passage means through which fluid under pressure can be supplied to act on said piston.

5. A nozzle according to claim 4 including a non return valve in said passage means.

6. A nozzle according to claim 1 in which resilient means biases the sleeve member towards the open end of the drilling, said tubular member extending into the open end of said drilling and said resilient means acting to bias the sleeve member into sealing engagement with said tubular member.

* * * * *